US011572894B2

(12) United States Patent
Kanzaka et al.

(10) Patent No.: US 11,572,894 B2
(45) Date of Patent: Feb. 7, 2023

(54) CENTRIFUGAL COMPRESSOR AND SUPERCHARGER

(71) Applicant: MITSUBISHI HEAVY INDUSTRIES ENGINE & TURBOCHARGER, LTD., Sagamihara (JP)

(72) Inventors: Tadashi Kanzaka, Tokyo (JP); Yosuke Dammoto, Tokyo (JP); Yoji Akiyama, Tokyo (JP); Takao Yokoyama, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 340 days.

(21) Appl. No.: 16/066,130

(22) PCT Filed: Feb. 15, 2016

(86) PCT No.: PCT/JP2016/054275

§ 371 (c)(1),
(2) Date: Jun. 26, 2018

(87) PCT Pub. No.: WO2017/141312

PCT Pub. Date: Aug. 24, 2017

(65) Prior Publication Data

US 2020/0166051 A1 May 28, 2020

(51) Int. Cl.

| | |
|---|---|
| ***F04D 29/58*** | (2006.01) |
| ***F04D 29/02*** | (2006.01) |
| ***F04D 29/42*** | (2006.01) |

(52) U.S. Cl.
CPC ..... *F04D 29/5853* (2013.01); *F04D 29/023* (2013.01); *F04D 29/4206* (2013.01);
(Continued)

(58) Field of Classification Search
CPC ..... F04D 29/02; F04D 29/023; F04D 29/40; F04D 29/403; F04D 29/4206;
(Continued)

(56) References Cited

U.S. PATENT DOCUMENTS

| | | | | |
|---|---|---|---|---|
| 5,333,990 | A * | 8/1994 | Foerster | F04D 29/685 415/58.4 |
| 5,785,493 | A * | 7/1998 | Ojima | F02C 6/12 415/174.1 |
| 5,961,281 | A | 10/1999 | Ojima et al. | |
| 2002/0114693 | A1 * | 8/2002 | Bartholoma | F01D 9/026 415/9 |

(Continued)

FOREIGN PATENT DOCUMENTS

| | | | |
|---|---|---|---|
| JP | 11-30190 | A | 2/1999 |
| JP | H1130190 | A * | 2/1999 |

(Continued)

OTHER PUBLICATIONS

International Search Report (Form PCT/ISA/210) for International Application No. PCT/JP2016/054275, dated May 17, 2016, with English translation.

(Continued)

*Primary Examiner* — Woody A Lee, Jr.
*Assistant Examiner* — Justin A Pruitt
(74) *Attorney, Agent, or Firm* — Birch, Stewart, Kolasch & Birch, LLP

(57) ABSTRACT

A centrifugal compressor (P) is provided with: a casing (10) which forms an impeller inlet flow path (11), an impeller flow path (12), an impeller outlet flow path (13), and a scroll (14); and an impeller (3) which is arranged in the impeller flow path (11), wherein the casing (10) is provided with a casing body (15) and a heat conduction inhibiting part (16) which is disposed to heat conduction paths to the impeller inlet flow path (11) from at least the impeller outlet flow path (13) and the scroll (14) so as to inhibit heat conduction to the impeller inlet flow path (11) from at least the impeller outlet flow path (13) and the scroll (14).

4 Claims, 5 Drawing Sheets

(52) U.S. Cl.
CPC .. *F05D 2300/43* (2013.01); *F05D 2300/5024* (2013.01); *F05D 2300/603* (2013.01)

(58) Field of Classification Search
CPC ..... F04D 29/4213; F04D 29/5853; F05D 2300/43; F05D 2300/5024; F05D 2300/603; Y02T 10/144; F01D 25/08
USPC ..... 415/177
See application file for complete search history.

(56) References Cited

U.S. PATENT DOCUMENTS

| | | | | |
|---|---|---|---|---|
| 2005/0193738 | A1 | 9/2005 | Hayasaka et al. | |
| 2012/0099980 | A1* | 4/2012 | Nishita | F04D 29/023 415/200 |
| 2016/0201693 | A1 | 7/2016 | An et al. | |

FOREIGN PATENT DOCUMENTS

| | | | | |
|---|---|---|---|---|
| JP | 2001234753 | A | * | 8/2001 |
| JP | 2005-36664 | A | | 2/2005 |
| JP | 2005-147079 | A | | 6/2005 |
| JP | 5622965 | B1 | | 11/2014 |
| WO | WO 2010/122026 | A1 | | 10/2010 |

OTHER PUBLICATIONS

Written Opinion of the International Searching Authority (Form PCT/ISA/237) for International Application No. PCT/JP2016/054275, dated May 17, 2016, with English translation.

* cited by examiner

CENTRIFUGAL COMPRESSOR AND SUPERCHARGER

TECHNICAL FIELD

The present invention relates to a centrifugal compressor and a turbocharger.

BACKGROUND ART

PTL 1 discloses a technology of inhibiting a choked flow rate from being reduced so as to expand an operation range of a centrifugal compressor while improving a surge margin, by decreasing a circulation resistance of air that flows in an intake air channel of the centrifugal compressor in a turbocharger.

More specifically, in PTL 1, in order to decrease the circulation resistance of intake air flowing in the intake air channel, there is provided a parallel flow generating unit that straightens the flowing in parallel with a rotary shaft that enters the intake air channel from an inlet. The parallel flow generating unit includes an outer cylinder member that fits in an inner circumferential wall of an upstream-side housing and a plurality of guide vanes arranged along the inner circumferential wall of the outer cylinder member at equal intervals in a circumferential direction.

Further, PTL 1 discloses that parallel flow generating means described above from the viewpoint of cost reduction is integrally formed of an aluminum material or a resin.

CITATION LIST

Patent Literature

[PTL 1] Japanese Patent No. 5622965

SUMMARY OF INVENTION

Technical Problem

The centrifugal compressor of the turbocharger disclosed in PTL 1 includes an impeller that increases temperature and pressure of the air. At that time, there is a possibility that heat of the air having the temperature increased by the impeller is likely to be transmitted to the intake air via a compressor casing. When the heat is transmitted to the intake air in this manner, an intake air temperature is increased, and thus compression performance of the centrifugal compressor is likely to be degraded.

An object of the invention is to provide a centrifugal compressor that is capable of inhibiting intake air temperature from increasing and, thus, improving compression performance, and a turbocharger.

Solution to Problem

According to a first aspect of the invention, there is provided a centrifugal compressor comprising: a casing which forms an impeller inlet flow path, an impeller flow path, an impeller outlet flow path, and a scroll; and an impeller which is disposed in the impeller flow path. The casing is provided with a casing main body, and a heat conduction inhibiting part which is disposed to heat conduction paths to the impeller inlet flow path from at least the impeller outlet flow path and the scroll so as to inhibit heat conduction to the impeller inlet flow path from at least the impeller outlet flow path and the scroll.

In such a configuration, the heat conduction inhibiting part inhibits heat from at least the impeller outlet flow path and the scroll, through which the air having the temperature increased by the impeller circulates, from being transmitted to the impeller inlet flow path via the heat conduction paths to the impeller inlet flow path from the impeller outlet flow path and the scroll. As a result, it is possible to inhibit intake air temperature from increasing and, thus, to improve compression performance.

According to a second aspect of the invention, in the centrifugal compressor, the heat conduction inhibiting part in the first aspect may be formed of a material having heat conductivity lower than that of the casing main body.

In such a configuration, it is possible to easily inhibit the heat from being transmitted to the impeller inlet flow path from at least the impeller outlet flow path and the scroll, only by disposing the heat conduction inhibiting part at an intermediate position in the heat conduction path.

According to a third aspect of the invention, in the centrifugal compressor, the heat conduction inhibiting part in the second aspect may be formed of carbon fiber reinforced plastic or glass fiber reinforced plastic.

In such a configuration, it is possible to inhibit the heat from being transmitted to the impeller inlet flow path from at least the impeller outlet flow path and the scroll, while the strength of the heat conduction inhibiting part is secured.

According to a fourth aspect of the invention, in the centrifugal compressor, the heat conduction inhibiting part in the first aspect may be formed of a free-machining material, which is cut by coming into contact with the impeller, and may form a cover portion which covers the impeller.

In such a configuration, even in a case where the impeller and the heat conduction inhibiting part come into contact with each other, there is no significant damage to the impeller. Therefore, it is possible to reduce a clearance between the impeller and the heat conduction inhibiting part. Further, since the heat conduction inhibiting part is disposed at a position opposite to a blade of the impeller, it is possible to still more inhibit the heat conduction to the impeller inlet flow path from the impeller flow path. As a result, it is possible to further achieve improvement in compression performance.

According to a fifth aspect of the invention, in the centrifugal compressor, the heat conduction inhibiting part in the first to third aspects may be integrally formed with an intake pipe through which an intake of air from outside is performed.

In such a configuration, it is possible to reduce the number of components, compared to a case where the heat conduction inhibiting part is formed as a separate member.

According to a sixth aspect of the invention, there is provided a turbocharger including: the centrifugal compressor according to any one of the first to fifth aspects.

In such a manner, it is possible to increase pressure by air without increasing the number of revolutions of a turbine. In other words, in a case where the same boost pressure as that of the turbocharger that does not include the heat conduction inhibiting part is intended to be obtained, it is possible to decrease the number of revolutions of the turbine.

Therefore, it is possible to achieve energy saving of an entire system on which the turbocharger is mounted.

Advantageous Effects of Invention

According to the centrifugal compressor and the turbocharger, it is possible to inhibit the intake air temperature from increasing and, thus, to improve compression performance.

DESCRIPTION OF EMBODIMENTS

First Embodiment

Next, a centrifugal compressor and a turbocharger in a first embodiment of the invention will be described based on figures.

Figure 1:
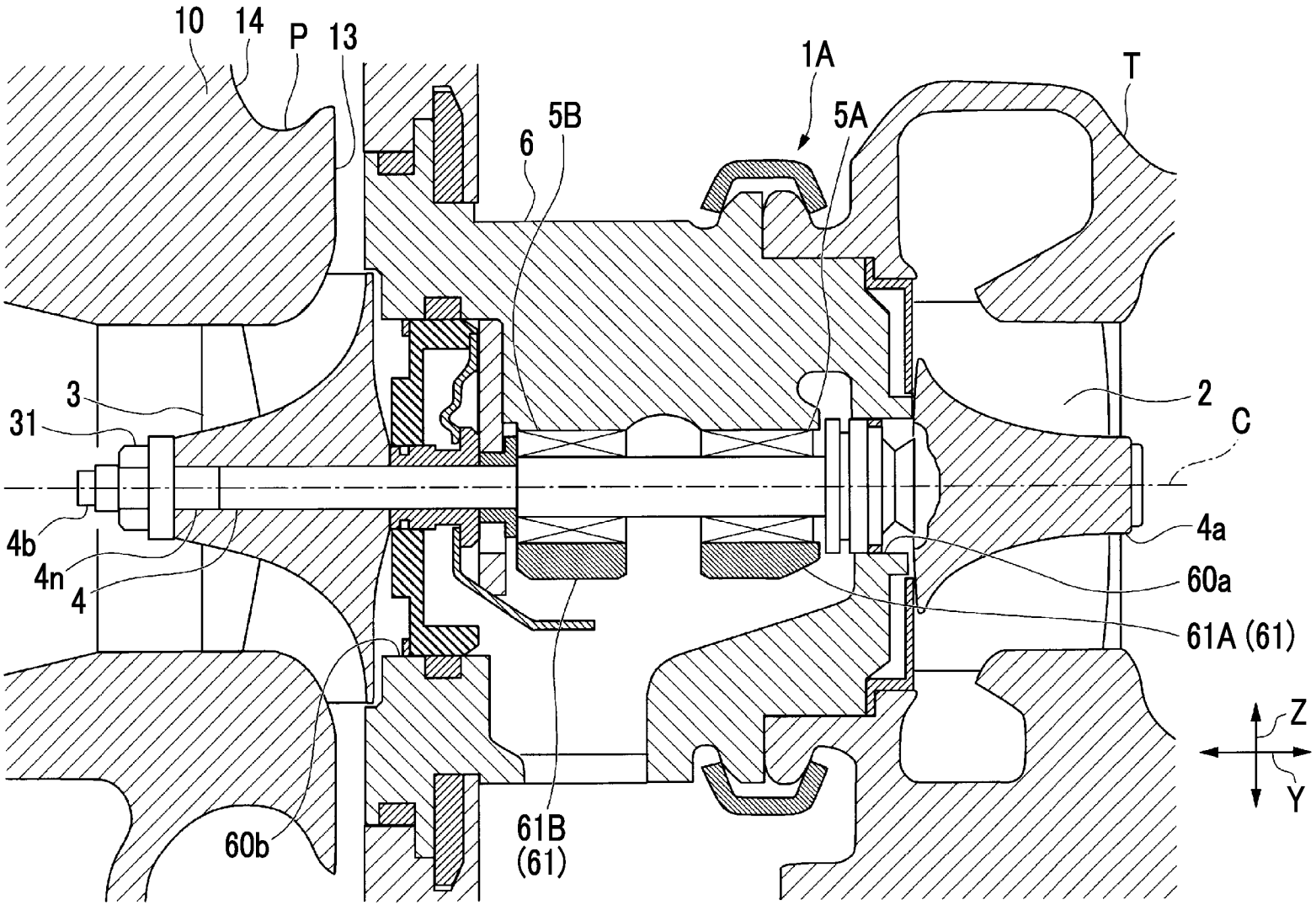
FIG. 1 is a sectional view of a turbocharger in a first embodiment of the invention.

FIG. 1 is a sectional view of the turbocharger in the first embodiment of the invention.

As illustrated in FIG. 1, a turbocharger 1A includes a turbine wheel 2, a compressor wheel (impeller) 3, a rotary shaft 4, journal bearings 5A and 5B, and a housing 6. For example, the turbocharger 1A is mounted as an auxiliary machine of an engine in an automobile or the like, in a posture in which the rotary shaft 4 is extended in a horizontal direction. Here, a dashed-dotted line in FIG. 1 represents a central axis (axis line) C of the rotary shaft 4.

In the turbocharger 1A, a flow of exhaust gas supplied to a turbine T from an engine (not illustrated) causes the turbine wheel 2 provided in the turbine T to rotate around the central axis C.

The rotary shaft 4 and the compressor wheel 3 rotate around the central axis C along with the rotation of the turbine wheel 2.

The housing 6 is supported by a vehicle body or the like via a bracket (not illustrated), a compressor P, the turbine T, and the like. The housing 6 includes bearing accommodating portions 61A and 61B that accommodate the journal bearings 5A and 5B inside the housing. The housing 6 is provided with an opening 60*a* on one end side thereof and an opening 60*b* on the other end side thereof. The rotary shaft 4 is supported by the journal bearings 5A and 5B accommodated in the bearing accommodating portions 61A and 61B such that the rotary shaft is rotatable around the central axis C. A first end portion 4*a* and a second end portion 4*b* of the rotary shaft 4 project to the outside of the housing 6 through the openings 60*a* and 60*b*. In other words, a part of the rotary shaft 4 in a length direction along the central axis C is accommodated in the housing 6.

In an axis line direction in which the central axis C is extended, the turbine wheel 2 is provided on a first side (right side in FIG. 1) of the housing 6, and the compressor wheel 3 is provided on a second side (left side in FIG. 1) of the housing 6. More specifically, the turbine wheel 2 is integrally provided on the first end portion 4*a* of the rotary shaft 4, and the compressor wheel 3 is coupled to a screw part 4*n* formed on the second end portion 4*b* of the rotary shaft 4, by screwing a nut 31. The turbine wheel 2 and the compressor wheel 3 rotate around the central axis C along with the rotary shaft 4.

The compressor P includes a compressor wheel 3 and a compressor casing 10.

The compressor wheel 3 is a so-called impeller and centrifugally compresses the air due to the rotation of the rotary shaft 4. More specifically, the temperature and the pressure of the air (intake air) flowing from the second side in the direction, in which the central axis C is extended, are increased so as to be fed to a diffuser (impeller outlet flow path) 13 formed on an outer side in a radial direction.

Figure 2:
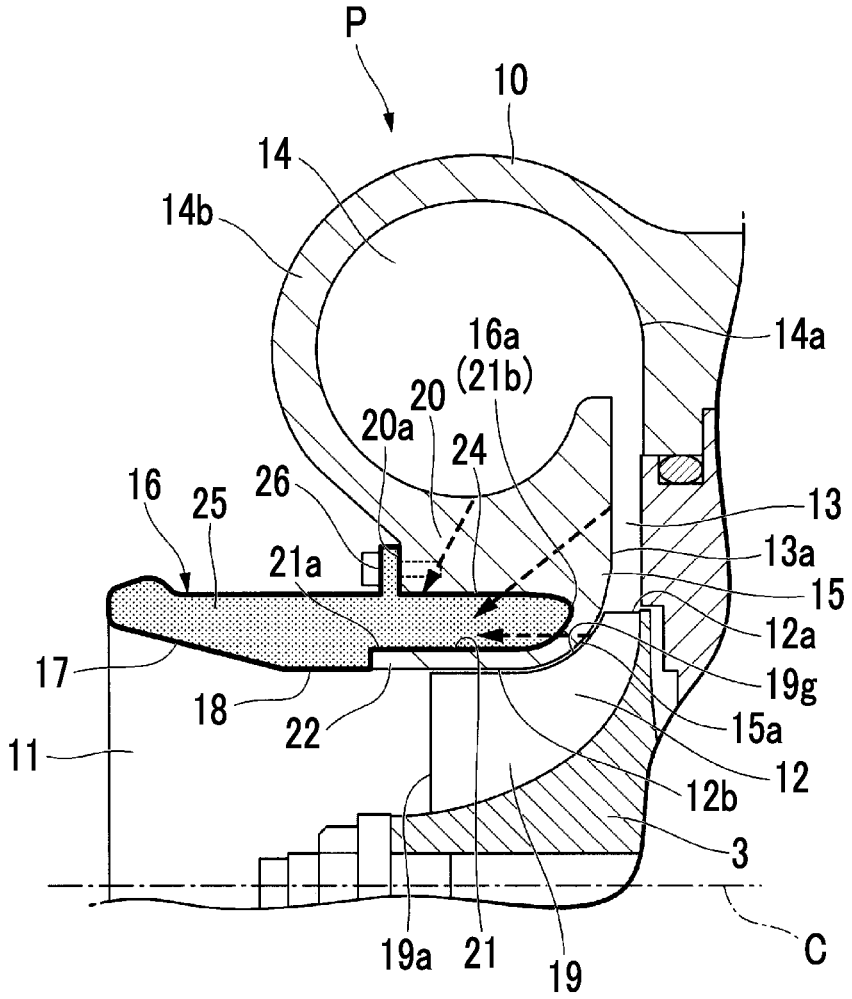
FIG. 2 is a sectional view of a compressor in the first embodiment of the invention.

FIG. 2 is a sectional view of the compressor in the first embodiment of the invention.

As illustrated in FIG. 2, the compressor casing 10 forms a wheel inlet flow path 11, a wheel flow path 12, a diffuser 13, and a scroll 14. The compressor casing 10 is configured of a casing main body 15 and a heat conduction inhibiting part 16.

For example, the wheel inlet flow path 11 is formed between the wheel flow path 12 and an intake pipe (not illustrated) that is extended from an air cleaner box or the like. The wheel inlet flow path 11 is provided with an inclined portion 17 of which a flow-path area is gradually reduced by approaching the compressor wheel 3 and a normal portion 18 which is disposed on a side closer to the compressor wheel 3 than the inclined portion 17 and of which a flow-path area does not change.

The wheel flow path 12 is formed of a space that accommodates the compressor wheel 3. The wheel flow path 12 forms a flow path through which compressed air flows, together with the compressor wheel 3. In other words, the wheel flow path 12 is also referred to as an accommodation chamber that accommodates the compressor wheel 3. In the wheel flow path 12, a small gap is formed between the blade portion 19 of the compressor wheel 3 and the compressor casing 10. In other words, the compressor casing 10 is provided with a curved surface 15*a* that is curved along an outer edge 19*g* of the blade portion 19 at a position opposite to the blade portion 19. In this manner, the wheel flow path 12 has a diameter that gradually expands from a side close to the wheel inlet flow path 11 toward the side of the turbine T and is formed to be curved such that an increase rate of the diameter thereof gradually increases.

The diffuser 13 is extended outward from the outermost circumferential portion 12*a* of the wheel flow path 12 in the radial direction around the central axis C. For example, the diffuser 13 converts kinetic energy of the air compressed by the compressor wheel 3 into pressure energy. The diffuser 13 connects the wheel inlet flow path 11 with the scroll 14.

The scroll 14 further converts the kinetic energy of the air flowing from the diffuser 13 into the pressure energy so as to discharge the air to the outside of the compressor casing 10. The air discharged through the scroll 14 is supplied to a cylinder or the like of an engine (not illustrated). The scroll 14 is formed to have a cross section illustrated in FIG. 2, and an end portion 14*a* of the scroll on the closest side to the turbine T is connected to the diffuser 13. The scroll 14 is formed at a position overlapping the compressor wheel 3, in the direction in which the central axis C is extended, and is extended in the circumferential direction around the central axis. An area of a cross section of the scroll 14 formed in such a manner gradually expands toward a discharge port (not illustrated) of the compressor P.

The casing main body 15 mainly forms the wheel flow path 12, the diffuser 13, and the scroll 14 and forms the wheel flow path 12, the diffuser 13, and the scroll 14 in an integral manner. The casing main body 15 is formed of aluminum, cast iron, or the like. The casing main body 15 includes the wheel flow path 12 on an inner side of the scroll 14 in a radial direction around the central axis C. An installing recessed portion 21 for installing the heat conduction inhibiting part 16 at an intermediate portion 20 between the scroll 14 and the wheel flow path 12. Here, the intermediate portion 20 is provided with a side surface 20*a* that is disposed to be closer to the second side (left side in FIG. 2) than the front edge 19*a* of the blade portion 19 of the compressor wheel 3, in the direction in which the central axis C is extended. The side surface 20*a* of the intermediate portion 20 is provided with a bead hole or the like for fixing the heat conduction inhibiting part 16.

Further, The casing main body 15 is provided with a projecting portion 22 that forms a part of the wheel inlet flow path 11 which is closest to the first side (right side in FIG. 2), so as to be closer to the inner side than the intermediate portion 20, in the radial direction around the central axis C. The projecting portion 22 is extended to be closer to the second side (left side in FIG. 2) than the front edge 19*a* of the blade portion 19 and the side surface 20*a* of the intermediate portion 20, in the direction in which the central axis C is extended.

The installing recessed portion 21 accommodates at least a part of the heat conduction inhibiting part 16. The installing recessed portion 21 in the embodiment has an inside that is to be filled with a main body 24 of the heat conduction inhibiting part 16. The installing recessed portion 21 is disposed at an intermediate position in a heat conduction path (represented by an arrow in FIG. 2) to the wheel inlet flow path 11 from the wheel flow path 12, the diffuser 13, and the scroll 14.

The installing recessed portion 21 is formed in the entire circumference in a circumferential direction around the central axis C and is formed to have a ring shape that is opened toward the second side in the direction in which the central axis C extended. The installing recessed portion 21 is extended to be closer to the first side, that is, to the side of the turbine T, than the front edge 19*a* of the blade portion 19 of the compressor wheel 3, in the direction in which the central axis C is extended. An end portion 16*a* of the installing recessed portion 21 in the embodiment reaches a position closest to an inner surface 13*a* of the diffuser 13 through a position closest to an inner surface 12*b* of the casing main body 15 which forms the wheel flow path 12.

The heat conduction inhibiting part 16 inhibits heat conduction to the wheel inlet flow path 11 from the wheel flow path 12, the diffuser 13, and the scroll 14. The heat conduction inhibiting part 16 is formed of a material having heat conductivity lower than that of the compressor casing 10. For example, it is possible to use a resin such as carbon fiber reinforced plastic (CFRP) or glass fiber reinforced plastic (GFRP) as the material having the heat conductivity lower than that of the compressor casing 10. For example, it is desirable that the heat conduction inhibiting part 16 is formed of a resin that does not melt due to a heat input from the wheel flow path 12, the diffuser 13, and the scroll 14.

The heat conduction inhibiting part 16 is provided with the main body 24 and an inlet flow path forming portion 25.

The main body 24 is accommodated in the installing recessed portion 21 described above. Similar to the installing recessed portion 21, the main body 24 is formed to have a ring shape that is extended in parallel with the central axis C. The main body 24 is provided with a protrusion 26 for being fixed to the compressor casing 10, and the main body 24 is fixed to the compressor casing 10 with beads or the like via a through-hole (not illustrated) of the protrusion 26.

The inlet flow path forming portion 25 forms the wheel inlet flow path 11 described above. The inlet flow path forming portion 25 is extended to be connected to the main body 24 in the direction in which the central axis C is extended. In other words, the inlet flow path forming portion 25 is formed to have a pipe shape provided with the inclined portion 17 and the normal portion 18 described above. The intake pipe (not illustrated) can be connected to the inlet flow path forming portion 25, and the air flowing from the intake pipe flows toward the compressor wheel 3 along the central axis C.

Hence, according to the first embodiment described above, the heat conduction inhibiting part 16 is provided, and thereby it is possible to inhibit the heat from being transmitted to the wheel inlet flow path 11 from the wheel flow path 12, the diffuser 13, and the scroll 14, through which the air having the temperature increased by the compressor wheel 3, via the heat conduction path to the wheel inlet flow path 11 from the wheel flow path 12, the diffuser 13, and the scroll 14.

As a result, it is possible to inhibit the intake air temperature from increasing and, thus, to improve compression performance.

Further, according to the first embodiment, the heat conduction inhibiting part 16 is formed of a material having the heat conductivity lower than that of the casing main body 15 of the compressor casing 10. Therefore, it is possible to easily inhibit the heat from being transmitted to the wheel inlet flow path 11 from the wheel flow path 12, the diffuser 13, and the scroll 14, only by disposing the heat conduction inhibiting part 16 at the intermediate position in the heat conduction path.

Further, in a case where the heat conduction inhibiting part 16 is formed of carbon fiber reinforced plastic or glass fiber reinforced plastic, there is an advantage in that it is possible to inhibit the heat conduction to the wheel inlet flow path 11 from the wheel flow path 12, the diffuser 13, and the scroll 14 while the strength of the heat conduction inhibiting part 16 is secured.

Further, since the heat conduction inhibiting part 16 includes the inlet flow path forming portion 25, it is possible to still more reduce transmission of the heat from the wheel flow path 12, the diffuser 13, and scroll 14 to the air flowing in the wheel inlet flow path 11.

Further, the turbocharger 1A includes the compressor P that is equipped with the heat conduction inhibiting part 16, thereby making it possible to increase the pressure of the air such that the pressure is higher than that in the turbocharger which does not include the heat conduction inhibiting part 16 without increasing the number of revolutions of the turbine T. In addition, compared to the turbocharger which does not include the heat conduction inhibiting part 16, it is possible to obtain the same boost pressure as that obtained by the smaller number of revolutions of the turbine T.

Therefore, it is possible to achieve energy saving of an entire system on which the turbocharger 1A is mounted.

Second Embodiment

Next, a second embodiment of the invention will be described, based on figures. Only a configuration of a heat conduction inhibiting part of the second embodiment differs from the first embodiment described above. Therefore, the same reference signs are assigned to the same portions as those in the first embodiment, and the repeated description thereof is omitted.

Figure 3:
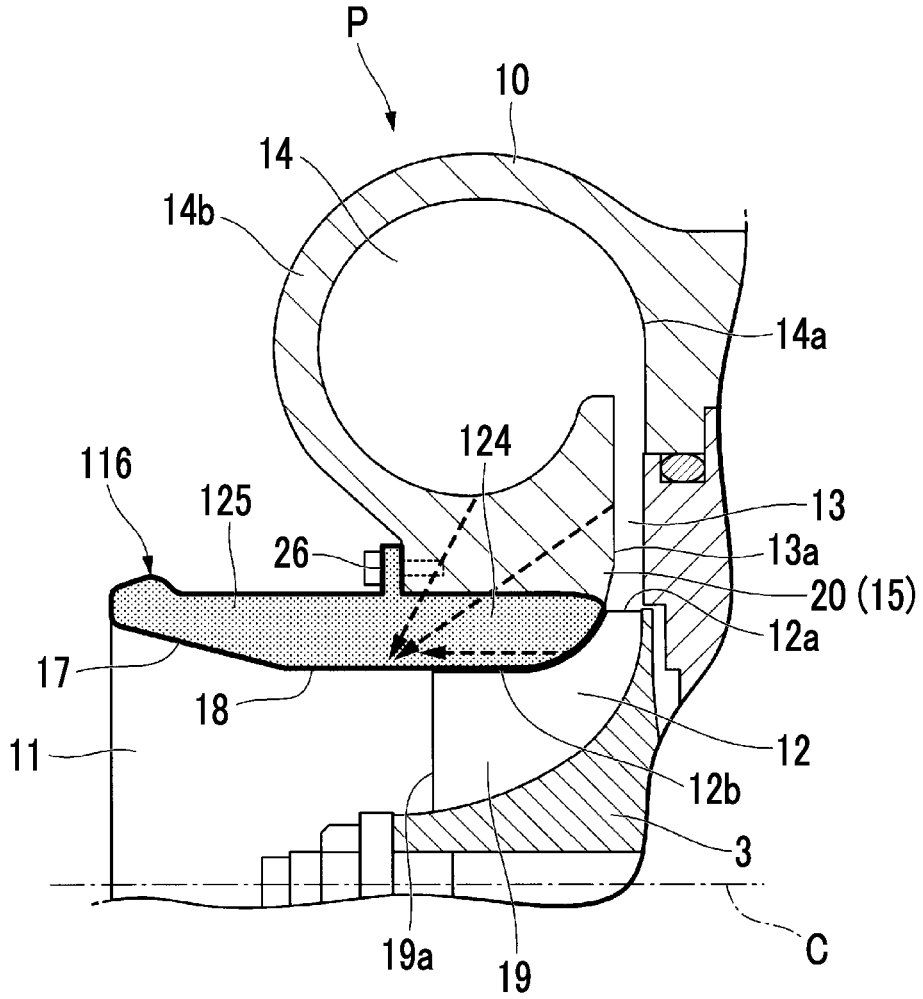
FIG. 3 is a sectional view corresponding to FIG. 2, in a second embodiment of the invention.

FIG. 3 is a sectional view corresponding to FIG. 2, in the second embodiment of the invention.

As illustrated in FIG. 3, a turbocharger in the second embodiment includes the compressor P. The compressor P includes the compressor wheel 3 and the compressor casing 10.

The compressor casing 10 mainly forms the wheel inlet flow path 11, the wheel flow path 12, the diffuser 13, and the scroll 14. The compressor casing 10 is configured of the casing main body 15 and a heat conduction inhibiting part 116.

The casing main body 15 mainly forms the diffuser 13 and the scroll 14 described above.

Similar to the heat conduction inhibiting part 16 of the first embodiment, the heat conduction inhibiting part 116 inhibits the heat conduction to the wheel inlet flow path 11 from the wheel flow path 12, the diffuser 13, and the scroll 14. The heat conduction inhibiting part 116 in the second embodiment is formed by connecting the inner surface 12*b* of the wheel flow path 12 and the inclined portion 17 and the normal portion 18 of the compressor casing 10 that forms the wheel inlet flow path 11.

The heat conduction inhibiting part 116 is formed of a material having the heat conductivity lower than a material of which the casing main body 15 is formed. Further, the heat conduction inhibiting part 116 is formed of a free-machining material (in other words, an abradable material). For example, it is possible to use polytetrafluoroethylene (Teflon (registered trademark)) as the free-machining material. Similar to the first embodiment, for example, it is desirable that the heat conduction inhibiting part 116 is formed of a resin that does not melt due to the heat input from the wheel flow path 12, the diffuser 13, and the scroll 14.

The heat conduction inhibiting part 116 is provided with a main body 124 and an inlet flow path forming portion 125. The inlet flow path forming portion 125 is formed to have the same shape as the inlet flow path forming portion 25 of the first embodiment described above.

The main body 124 forms a cover portion (referred to as a shroud) of the compressor wheel 3. The main body 124 is disposed with respect to the blade portion 19 of the compressor wheel 3 via a gap smaller than the gap between the blade portion 19 and the inner surface 12*b* of the casing main body 15 of the first embodiment. The main body 124 is provided with the protrusion 26 for being fixed to the compressor casing 10, and the main body 124 is fixed to the compressor casing 10 with beads or the like via the protrusion 26.

Hence, according to the second embodiment, the heat conduction inhibiting part 116 can inhibit the heat from the wheel flow path 12, the diffuser 13, and the scroll 14, through which the air having the temperature increased by the compressor wheel 3 circulates, from being transmitted to the wheel inlet flow path 11, via the heat conduction path to the wheel inlet flow path 11 from the wheel flow path 12, the diffuser 13, and the scroll 14.

Further, the heat conduction inhibiting part 116 is formed of the free-machining material, and thereby there is no significant damage to the blade portion 19 of the compressor wheel 3 even in a case where the blade portion 19 of the compressor wheel 3 and the heat conduction inhibiting part 116 come into contact with each other. Therefore, it is possible to reduce a clearance between the blade portion 19 of the compressor wheel 3 and the heat conduction inhibiting part 116. Further, since the heat conduction inhibiting part 116 is disposed at a position opposite to the blade portion 19 of the compressor wheel 3, it is possible to still more inhibit the heat conduction to the wheel inlet flow path 11 from the wheel flow path 12. As a result, it is possible to further improve the compression performance.

Third Embodiment

Next, a third embodiment of the invention will be described, based on figures. Only a configuration of a heat conduction inhibiting part of the second embodiment differs from the first embodiment described above. Therefore, the same reference signs are assigned to the same portions as those in the first embodiment, and the repeated description thereof is omitted.

Figure 4:
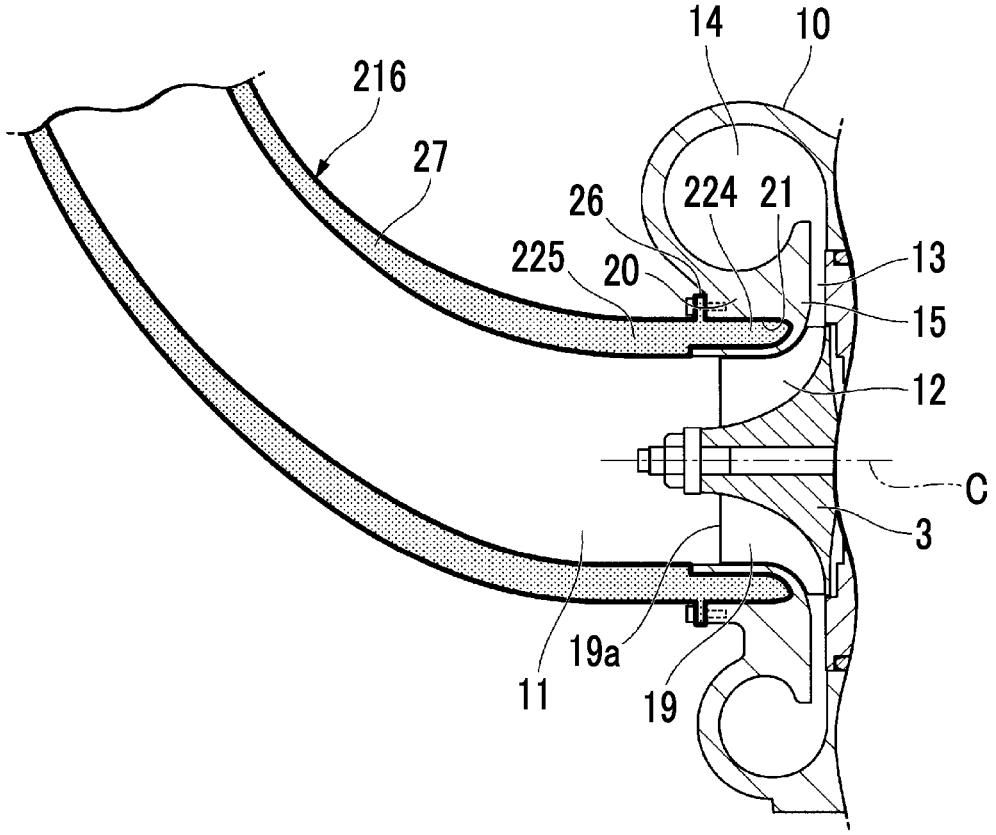
FIG. 4 is a sectional view corresponding to FIG. 2, in a third embodiment of the invention.

FIG. 4 is a sectional view corresponding to FIG. 2, in the third embodiment of the invention.

As illustrated in FIG. 4, the compressor P of a turbocharger in the third embodiment includes the compressor wheel 3 and the compressor casing 10.

The compressor casing 10 mainly forms the wheel inlet flow path 11, the wheel flow path 12, the diffuser 13, and the scroll 14. The compressor casing 10 is configured of the casing main body 15 and a heat conduction inhibiting part 216.

The heat conduction inhibiting part 216 is provided with a main body 224, an inlet flow path forming portion 225, and an intake pipe portion 27 in an integral manner. The main body 224 and the inlet flow path forming portion 225 have the same configurations as those of the first embodiment.

The intake pipe portion 27 has a pipe shape that forms a flow path through which an intake of the air from outside is performed. In other words, the heat conduction inhibiting part 216 of the third embodiment and the intake pipe, through which the intake of the air from outside is performed, are integrally provided.

In the heat conduction inhibiting part 216, the main body 224, the inlet flow path forming portion 225, and the intake pipe portion 27 are integrally formed of the same material as that of the first embodiment.

Hence, according to the third embodiment, in addition to the operation effects of the first embodiment described above, it is possible reduce the number of components even in a case where the heat conduction inhibiting part and the intake pipe are formed as separate members from each other. Therefore, it is possible to reduce man hour of assembly. For example, it is possible to reduce the takt time.

Other Modification Examples

The invention is not limited to the embodiments described above and includes embodiment obtained by variously modifying the embodiments described above within a range without departing from the gist of the invention. In other words, the specific shapes, configurations, or the like exemplified in the embodiments are only examples, and it is possible to appropriately perform modification.

For example, in the embodiments described above, the compressor P of the turbocharger is described as an example of the centrifugal compressor of the turbocharger. However, the turbocharger is not limited to the turbocharger described above and may be a supercharger or the like. Further, in the embodiments, the centrifugal compressor of the turbocharger is exemplified; however, the invention is not limited to the centrifugal compressor of the turbocharger. In other words, the invention is applicable to another centrifugal compressor other than the turbocharger.

Further, in the embodiments described above, an open type of impeller is exemplified. However, the impeller is not limited to the open type and may be a closed type of impeller that is integrally provided with a cover portion.

In the embodiments described above, the case where the heat conduction inhibiting part 16 is provided with the main body 24 and the inlet flow path forming portion 25 is described. However, the heat conduction inhibiting part is not limited to this configuration. In the heat conduction inhibiting part 16, the main body 24 and the inlet flow path forming portion 25 may be formed as separate members from each other.

Further, in the embodiments described above, the case where the inlet flow path forming portion 25 is provided with the inclined portion 17 and the normal portion 18 is described; however, the inlet flow path forming portion is not limited to that provided with the inclined portion 17 and the normal portion 18. For example, the inlet flow path forming portion 25 may not be provided with the inclined portion 17.

Figure 5:
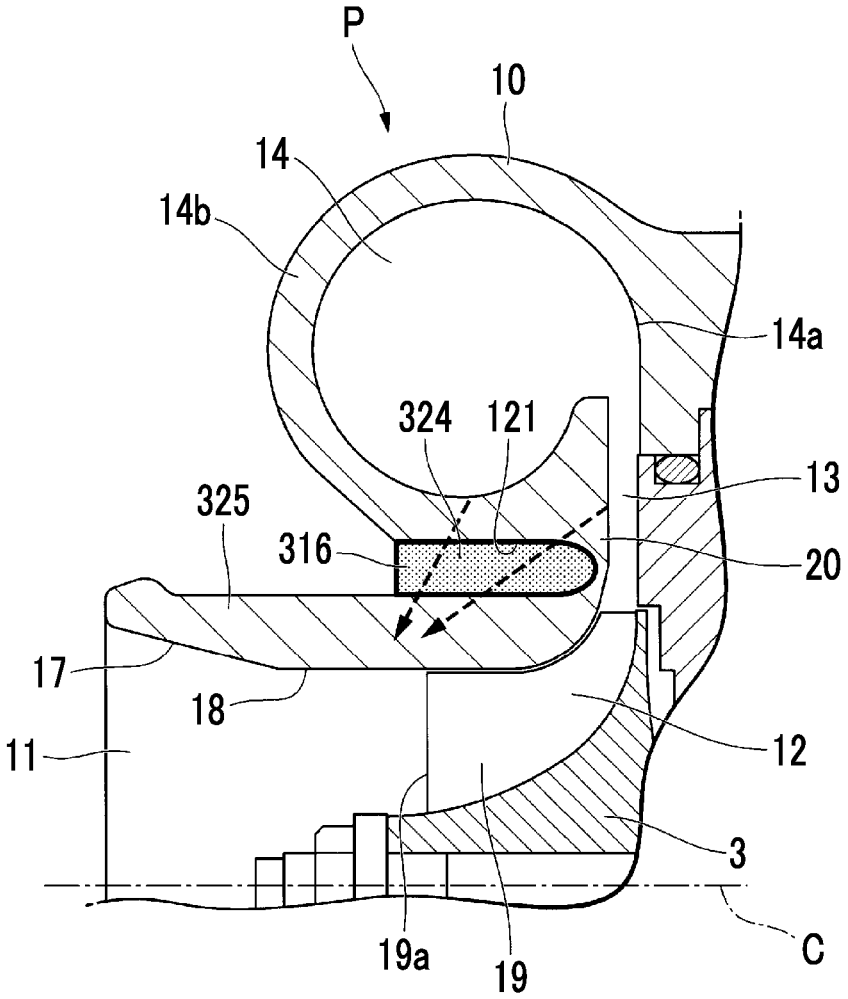
FIG. 5 is a sectional view corresponding to FIG. 2, in a modification example of the first embodiment of the invention.

FIG. 5 is a sectional view corresponding to FIG. 2, in a modification example of the first embodiment of the invention.

The heat conduction inhibiting part of the invention may be configured to be disposed in the heat conduction path (represented by a dashed arrow in FIG. 5) to the wheel inlet flow path 11 from the diffuser 13 and the scroll 14 and to be capable of inhibiting the heat conduction via the heat conduction path.

For example, as illustrated the modification example in FIG. 5, a heat conduction inhibiting part 316 may be formed only by a main body 324, and the casing main body 15 may be provided with an inlet flow path forming portion 325 that forms the wheel inlet flow path 11.

In this case, the installing recessed portion 121, in which the heat conduction inhibiting part (main body) 316 is installed, may be formed to be extended and to be closer to the side of the turbine T (first side on the right side in FIG. 5) than the front edge 19*a* of the blade portion 19 along the central axis C from the second side (left side in FIG. 5) at the intermediate portion 20 between the scroll 14 and the wheel flow path 12.

In the modification example illustrated in FIG. 5, the case where the heat conduction inhibiting part 316 and the installing recessed portion 121 is disposed at a position between the inlet flow path forming portion 325 and the scroll 14 in the radial direction around the central axis C is exemplified; however, the disposition is not limited thereto.

INDUSTRIAL APPLICABILITY

The invention is applicable to the centrifugal compressor and the turbocharger. According to the invention, it is possible to inhibit the intake air temperature from increasing and, thus, to improve the compression performance.

REFERENCE SIGNS LIST

1A: turbocharger
2: turbine wheel
3: compressor wheel (impeller)
4: rotary shaft
4*a*: first end portion
4*b*: second end portion
4*n*: screw part
5A: journal bearing
5B: journal bearing
6: housing
10: compressor casing (casing)
11: wheel inlet flow path (impeller inlet flow path)
12: wheel flow path (impeller flow path)
12*a*: outermost circumferential portion
12*b*: inner surface
13: diffuser (impeller outlet flow path)
13*a*: inner surface
14: scroll
14*a*: end portion
15: casing main body
16, 116: heat conduction inhibiting part
16*a*: end portion
17: inclined portion
18: normal portion
19: blade portion
19*a*: front edge
19*g*: outer edge
20: intermediate portion
20*a*: side surface
21*b*: end portion
21, 121: installing recessed portion
22: projecting portion
24, 124, 224: main body
25, 125, 225, 325: inlet flow path forming portion
26: protrusion
27: intake pipe portion
31: nut
60*a*: opening
60*b*: opening
61A: bearing accommodating portion
61B: bearing accommodating portion
C: central axis
P: compressor
T: turbine

The invention claimed is:

1. A centrifugal compressor comprising:

a casing which forms an impeller inlet flow path, an impeller flow path, an impeller outlet flow path, and a scroll; and an impeller which is disposed in the impeller flow path and rotatable around a central axis, the impeller having a blade portion, wherein, in the casing, the impeller inlet flow path, the impeller flow path, the impeller outlet flow path, and the scroll are connected such that air flows from the impeller inlet flow path to the impeller flow path in an axial direction that is a direction in which the central axis extends, is fed to the impeller outlet flow path formed on an outside of the impeller flow path in a radial direction with respect to the central axis and extending in the radial direction, and flows from the impeller outlet flow path into the scroll, wherein the casing includes a casing main body which forms the impeller flow path, the impeller outlet flow path, and the scroll, and a heat conduction inhibiting part which is disposed to heat conduction paths to the impeller inlet flow path from at least, the impeller flow path, the impeller outlet flow path and the scroll so as to inhibit heat conduction to the impeller inlet flow path from at least the impeller flow path, the impeller outlet flow path and the scroll, wherein, in the impeller flow path, an outer edge of the blade portion opposes the casing main body in the radial direction, wherein the casing main body has a recessed portion in an intermediate portion between the scroll and the impeller flow path, the recessed portion being formed in an entire circumference in a circumferential direction around the central axis, being opened toward an intake side that is a side from which the air flows in in the axial direction, and extending to be closer to a side opposite to the intake side than a front edge of the blade portion, wherein the heat conduction inhibiting part, is formed of a material having heat conductivity lower than that of the casing main body, and wherein the heat conduction inhibiting part is formed of carbon fiber reinforced plastic or glass fiber reinforced plastic, wherein the heat conduction inhibiting part includes a main body and an inlet flow path forming portion, wherein the recessed portion has an inside thereof filled with the main body of the heat conduction inhibiting part, wherein the inlet flow path forming portion forms the impeller inlet flow path, wherein the impeller inlet flow path includes an inclined portion of which a flow-path area is gradually reduced by approaching the impeller and a normal portion which is disposed on a side closer to the impeller than the inclined portion and of which a flow-path area does not change, and wherein the main body of the heat conduction inhibiting part includes a protrusion having a through-hole, and is fixed to the casing main body via the through-hole.

2. The centrifugal compressor according to claim 1, wherein the heat conduction inhibiting part and an intake pipe, through which an intake of air from outside is performed, are integrally formed.

3. A turbocharger comprising:

the centrifugal compressor according to claim 1.

4. A turbocharger comprising:

the centrifugal compressor according to claim 2.

* * * * *